United States Patent [19]

McMaster

[11] Patent Number: 4,660,024

[45] Date of Patent: Apr. 21, 1987

[54] DUAL TECHNOLOGY INTRUDER DETECTION SYSTEM

[75] Inventor: Richard L. McMaster, Pittsford, N.Y.

[73] Assignee: Detection Systems Inc., Fairport, N.Y.

[21] Appl. No.: 809,220

[22] Filed: Dec. 16, 1985

[51] Int. Cl.[4] ..... G08B 19/00; G08B 13/18

[52] U.S. Cl. ..... 340/522; 340/506; 340/521; 340/552; 340/554; 340/561; 367/94

[58] Field of Search ..... 340/522, 521, 506–508, 340/552–554, 561; 367/93, 94

[56] References Cited

U.S. PATENT DOCUMENTS 3,801,978 4/1974 Gershberg et al. ..... 340/522

4,405,919 9/1983 Scheidweiler ..... 340/522

*Primary Examiner*—Donnie L. Crosland

*Attorney, Agent, or Firm*—Warren W. Kurz

[57] ABSTRACT

A dual-tech intruder detection system includes a pair of intruder-detecting subsystems, each functioning to detect intrusion by a technology different from the other, and apparatus for activating an alarm in response to both subsystems detecting intrusion within a predetermined time interval. A supervisory circuit serves to detect a malfunction in one of the subsystems. Default apparatus, responsive to the output of the supervisory circuit, causes the alarm activating apparatus to activate an alarm in response to the still functioning subsystem's detection of intrusion.

7 Claims, 2 Drawing Figures

DUAL TECHNOLOGY INTRUDER DETECTION SYSTEM

BACKGROUND OF THE INVENTION

The present invention relates to the art of intrusion detection. More particulary, it relates to improvements in intruder detection systems of the so-called "dual technology" variety.

Heretofore, a variety of "technologies" have been used to detect the presence of an intruder in region under surveillance. Microwave, ultrasonic, photoelectric and passive infrared are some of the more common technologies in current use. Each has certain unique advantages and disadvantages which makes it more or less desirable for a particular environment or application. None is fool-proof, and all are subject to the ever-annoying false alarm.

In the never-ending struggle to provide the perfect intruder detection system, "perfect" from the standpoint that it never false alarms, proposals have been made to combine two (or more) technologies in a common intruder detection system. See, for example, the disclosures of U.S. Pat. Nos. 3,725,888; 3,801,978; 4,243,979; 4,275,390; 4,331,952 and 4,401,976. While such proposals go back at least twenty five years (see, e.g., U.S. Pat. No. 3,074,053), only recently has the cost of electronics reached a level that has made commercialization of a "dual-tech" system viable.

In conventional dual-tech systems, the outputs of the different intruder-detecting subsystems (e.g. microwave and passive infrared subsystems) are fed to an AND gate or its equivalent. Only in the event that the outputs of both subsystems indicate that both subsystems have detected intrusion substantially simultaneously, or within a predetermined time interval, will the AND gate provide an alarm-activating signal. The advantage of such a system, of course, is that false alarms will only occur on the relatively rare occasion that a spurious or false alarming-producing event is detected by both subsystems at about the same time. By combining relatively diverse technologies, e.g. microwave and photoelectric or passive infrared, the probability of false alarming can be minimized.

Heretofore, none of the proposed dual technology intruder detection systems has included any supervisory circuit for detecting a malfunction of either, or both, of the detection subsystems. It will be appreciated that, in the event only one subsystem fails, the entire system becomes inoperative since the AND gate requires two inputs, one from each subsystem, to activate an alarm. Worse yet, the inoperability of the system is not always readily detectable to the user. The problem of subsystem drop-out is particularly prevalent in dual-tech systems in which one of the subsystems is "active" in nature, e.g., conventional microwave, ultrasonic and beam-type photoelectric detection systems. In such systems, electromagnetic or acoustic energy is transmitted into a region under surveillance, and changes in the reflected or reflected energy are monitored. All too frequently, the transmitter (or receiver) element in such active systems fails and, without supervision, the entire dual technology system becomes inoperative.

SUMMARY OF THE INVENTION

In view of the foregoing discussion, an object of this invention is to provide a more reliable intruder detection system of the dual-tech variety, one which will continue to provide protection to a region of interest notwithstannding a failure or malfunction of one of the system's intruder-detecting subsystems.

In accordance with the present invention, there is provided a dual technology intruder detection system which, like prior art systems, includes a plurality of detecting subsystems, each being designed to detect intrusion by a different technology, and means for activating an alarm only in response to both subsystems detecting an event substantially simultaneously. The detection system of the invention, however, is characterized by at least one supervisory circuit which, in response to a malfunction of the particular subsystem of which it is a part, produces an output signal. According to a preferred embodiment, such output signal is used selectively to either produce an immediate system alarm, or to default to the still operating subsystem(s) so that protection continues to be provided thereby.

The invention and its various advantages will become more apparent to those skilled in the art from the ensuing detailed description of a preferred embodiment, reference being made to the accompanying drawings.

DETAILED DESCRIPTION OF PREFERRED EMBODIMENTS

Figure 1:
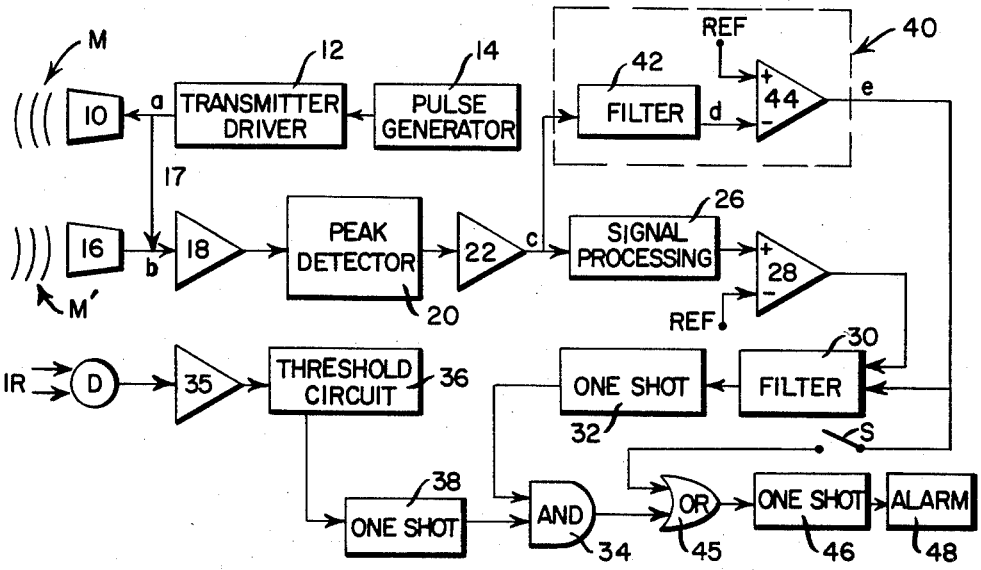
FIG. 1 is a block circuit diagram of a dual-tech intruder detection system embodying the present invention.

Referring now to the drawings, FIG. 1 illustrates a dual-tech intruder detection system of the microwave/infrared type. The microwave subsystem is "active" in nature, functioning to transmit microwave energy into a region to be protected from intrusion, and to detect such energy upon being reflected and possibly modified in frequency and/or phase by objects moving within such region. In contrast, the infrared subsystem is "passive" in nature, acting to detect the intruder's presence by his own body heat. As will be apparent, the technology of the intruder detecting subsystems could take any of many forms, active and/or passive.

Conventional microwave subsystems are commonly of the Doppler variety, typically comprising a Gunn diode 10 which is driven via a driver circuit 12 to produce modulated microwave energy M. The modulation may be prduced, for example, by a pulse generator 14 or some other periodic signal source. Movement of objects within the energy field produces a shift in frequency of the transmitted signal, such frequency shift being caused by the well-known Doppler effect. The Doppler frequency is the difference in frequency between the transmitted and motion-shifted frequencies, and it is this doppler signal which is processed to detect a particular type of movement.

The receiver portion of the microwave subsystem comprises a receiver diode 16 positioned to detect reflected microwave energy M', as returned from the protected area. A portion of the transmitted energy is directly coupled to the receiver, e.g., by locating the receiver diode within the energy field of the transmitting diode. Such coupling is denoted by the coupling line 17. In addition to providing a reference signal for subsequent Doppler frequency detection, the coupled energy also serves to bias the receiver "on" to demonstrate to the supervisory circuit (described below) that the transmitter is indeed transmitting and that the receiver is receiving.

In the particular microwave subsystem shown in FIG. 1, the output of receiver diode 16 is fed to an inverting pulse amplifier 18 whose output is peak-detected by detector 20 to produce the Doppler frequency. The Doppler signal is enhanced by amplifier 22 and the output thereof is filtered and further amplified in a conventional manner by an appropriate signal processing circuit 26 to exclude certain false alarm-producing signals. The output of circuit 26 is then threshold-detected by comparator 28 which compares the signal level with a reference voltage. Upon being further filtered by filter 30, the output of comparator 28 is used to trigger a conventional trigger circuit, e.g., a monostable multivibrator, denoted by one-shot 32. The pulse from the one shot, which may last one second or so, produces a "1" at one terminal of AND circuit 34, the other terminal of which is connected to the output of the passive infrared subsystem, described below. When both inputs to the AND circuit are "1", an alarm is produced through the series combination of OR circuit 45, a one-shot 46 and an alarm relay 48.

Briefly, the infrared subsystem comprises a standard IR detector D which is positioned to be irradiated by the body heat of an intruder within the protected region. Typically, a lens system, not shown, focuses infrared radiation onto the detector, such radiation emanating in one of a plurality of different fields of view within the region under surveillance. The output of detector D is amplified by amplifier 35 and, after conventional signal processing and filtering, not shown, to minimize false alarming, the resulting signal is threshold detected by circuit 36 (e.g., a comparator). The output of threshold detector 36 is used to trigger a second trigger circuit, here shown as one-shot 38, and the output pulse thereof e.g., a one second pulse, is fed to the other input of AND circuit 34.

Now, in accordance with the present invention, a supervisory circuit 40 is operatively connected to the microwave subsystem to monitor the operability of various components thereof. By coupling the supervisory circuit to the output of the Doppler amplifier 22, as shown, the operability of subsystem components "upstream" of the tap point can be monitored, including the transmitter's power supply, pulse generator and Gunn diode, as well as the front end of the receiver. The supervisory circuit basically comprises a filter 42 having a relatively long time constant, and a threshold detector, represented by comparator 44. When the output of filter 42 exceeds a predetermined threshold, determined by the reference voltage serving as the fixed input to comparator 44, a supervisory signal e is produced. The supervisory signal is passed through filter 30 to provide the same type of filtering as is provided for the alarm signal coming from comparator 28. Thus, a false supervisory signal, as might result from an electrical transient, would be filtered out.

According to a preferred embodiment, the filtered supervisory signal is used to fire one-shot 32 which, as noted above, provides an input to AND circuit 34. If the supervisory signal is sustained, as would be the case of a continuous subsystem malfunction, the output of the one-shot will be sustained, and a "1" will continue to appear at the input of circuit 34. If the supervisory signal is only momentary, but still long enough to pass through filter 30, the input to circuit 34 may last for only one second, as determined by the one-shot's time constant. Note, so long as the supervisory signal produces a "1" at one of the inputs to circuit 34, the system defaults to the still working intruder detecting subsystem, in this case the infrared subsystem. Hence, protection is still afforded by the system, notwithstanding a failure by one subsystem. To alert the user of a subsystem failure, an indicator (e.g. a light-emitting diode) can be energized by the output of one-shot 32.

Rather than defaulting to the working subsystem the supervisory signal e can be used to produce an immediate alarm. This is achieved by merely closing switch S, thereby connecting the supervisory signal directly to one input of OR circuit 45. The OR circuit, of course, will produce an alarm-activating signal in the event a "1" appears at either input.

Figure 2:
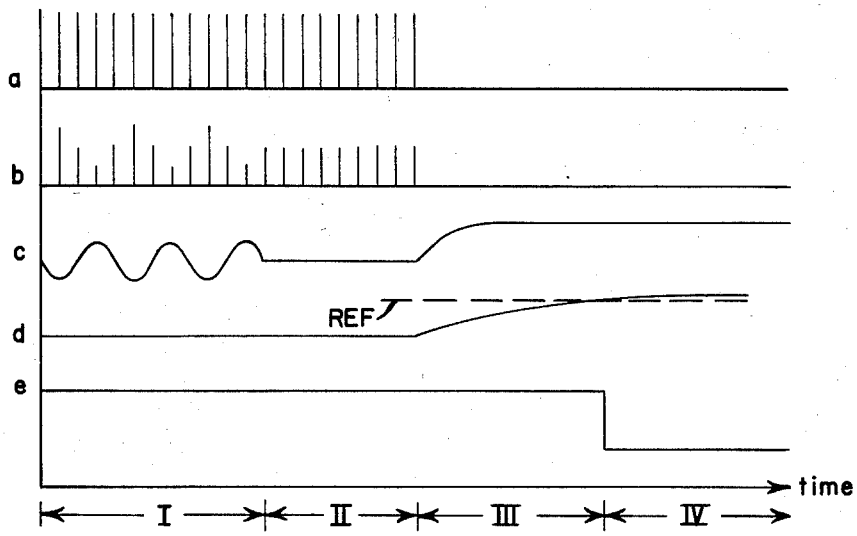
FIG. 2 illustrates various waveforms of signals produced by the circuit of FIG. 1.

Referring to FIG. 2, the output of various components of the FIG. 1 system are shown under four different conditions, indicated by time periods I–IV. During period I, there is movement in the protected region and a Doppler effect is produced. Thus, the pulsed input b to receiver amplifier 18 is modulated at the Doppler frequency, and the amplified output c of the peak detector 20 is a sine wave of the Doppler frequency. Because either amplifier 18 or 22 is of the inverting type, the modulated signal c is 180 degrees out of phase with the output of the receiver diode 16. Due to the slow response of filter 42, its output d remains at a relatively steady-state value corresponging to the average value of signal c, a value less than the threshold required to produce a supervisory signal from comparator 44.

During time period II, there is no movement in the protected region. Thus, the output b of receiver diode 16 is not modulated, and a steady state signal c appears of the output of the Doppler amplifier, such signal having the same value as the average value of the Doppler signal. Again, no supervisiory signal is produced.

During time period III, however, the transmitter malfunctions and no microwave energy is transmitted or received. Thus, the output of the receiver diode is zero, causing the inverted output of Doppler amplifier 22 to rise to a DC level determined by the peak detector output. As this occurs, the output d of filter 42 gradually increases and, when the output of filter 42 reaches the threshold defined by the reference voltage applied to comparator 44, a supervisory signal e is generated. This occurs during time period IV.

From the foregoing, it is apparent that relatively simple, yet elegant circuitry has been provided for curing a serious disadvantage of dual-tech systems. As a result, the level of protection is increased and, therefore, such systems will be far more reliable in the protection they afford, an advantage achieved at a relatively insignificant increase in manufacturing cost.

While the invention has been disclosed with reference to a preferred embodiment, various modifications and extensions will immediately suggest themselves to those skilled in the art. For example, both subsystems may be supervised and the output of the respective supervisory circuits used to default to the still operating subsystems. In passive systems, e.g. passive IR, this can be achieved by incorporating a source, e.g. a heat source, to periodically trigger the receiver output to determine whether the receiver is still working. Also, the supervisory circuit could be connected at any point in the subsystem, such as, directly to the output of the receiver diode, recognizing that the operability of circuit elements downstream of the tap point will not be supervised. Such obvious modifications and extensions are intended to fall within the spirit of the invention, as I have attempted to define by the attached claims.

I claim:

1. A dual-technology intruder detection system comprising first and second intruder-detecting subsystems, each being adapted to detect intrusion by a different technology and to produce an output signal in response to intrusion detection, means for normally activating an alarm in response to the production of output signals from said first and second subsystems within a predetermined time interval, a supervisory circuit, operatively connected to one of said subsystems for producing a supervisory signal in response to a malfunction of said one subsystem, and default means, responsive to said supervisory signal, for causing said alarm-activating means to activate an alarm in response to receipt of an output signal from only the other of said subsystems.

2. The invention as defined by claim 1 wherein the technology of one of said subsystems in microwave, and the technology of the other of said subsystems is passive-infrared.

3. The invention as defined by claim 1 wherein said means for normally activating an alarm comprises a logic circuit of the type which provides an output signal only in response to receiving two or more input signals simultaneously, and wherein said supervisory signal is operatively coupled to said first logic circuit.

4. The invention as defined by claim 3 wherein supervisory signal is operatively coupled to said first logic circuit through a trigger circuit.

5. The invention as defined by claim 3 wherein said means for normally activating an alarm further comprises a second logic circuit of the type which provides an output in response to receiving any one of a plurality of input signals, a trigger circuit, and an alarm relay, all connected in series, the outputs of said first logic circuit and said supervisory circuit serving as inputs to said second logic circuit, and wherein switch means are provided for selectively decoupling said supervisory signal from said second logic circuit, whereby said supervisory signal can selectively cause an alarm or cause said system to default to said second subsystem.

6. The invention as defined by claim 1 wherein one of said subsystems comprises an active detection system of the Doppler type, such system having circuit means for producing a signal of the Doppler frequency in response to intrusion detection, and wherein said supervisory circuit is coupled to said circuit means to monitor the output thereof.

7. The invention as defined by claim 6 wherein said supervisory circuit comprises a bandpass filter and threshold detecting circuit connected in series.

* * * * *